United States Patent [19]

Hicks et al.

[11] Patent Number: 4,911,829

[45] Date of Patent: Mar. 27, 1990

[54] ELECTROLYSIS CELL MEMBRANE HANGER

[75] Inventors: Roy L. Hicks; Gerald L. Shoults, Deer Park; Hiep D. Dang, Lake Jackson, all of Tex.

[73] Assignee: The Dow Chemical Company, Midland, Mich.

[21] Appl. No.: 220,058

[22] Filed: Jul. 15, 1988

[51] Int. Cl.[4] ..... C25B 9/00

[52] U.S. Cl. ..... 204/279

[58] Field of Search ..... 204/279, 252, 286, 255, 204/253-254

[56] References Cited

U.S. PATENT DOCUMENTS 3,335,079 8/1967 Nellen ..... 204/279

3,980,544 9/1976 Adams et al. ..... 204/286

4,170,535 10/1979 Smura ..... 204/279

4,792,386 12/1988 McMichael ..... 204/279

FOREIGN PATENT DOCUMENTS 59-159992 9/1984 Japan .

OTHER PUBLICATIONS

Technical Bulletin 88-04 by DuPont Co. 3-17-88.

*Primary Examiner*—Donald R. Valentine

[57] ABSTRACT

A membrane hanger device which secures a membrane and facilitates the handling of a membrane during installation and removal from an electrolytic cell. The installation time of the membrane is reduced because of better handling of the membrane.

9 Claims, 2 Drawing Sheets

ELECTROLYSIS CELL MEMBRANE HANGER

BACKGROUND OF THE INVENTION

This invention relates to a device for securing electrolysis cell membranes and more specifically, to a device which holds electrolysis cell membranes securely in place during the membrane's installation and removal from an electrolytic cell.

Electrolytic cells utilizing a membrane member are well known. There are also many well-known membranes for use in such electrolytic cells. For example, typical membranes include the perfluorinated carboxylic or sulfonic cation exchange membranes such as Nafion® manufactured by E. I. duPont de Nemours and Company or Flemion® manufactured by Asahi Glass Company, Ltd. These membranes are typically available in sheet form and employed in filter press-type or flat plate-type electrolytic cells having monopolar or bipolar electrodes.

Examples of bipolar, filter press-type cells are described in U.S. Pat. Nos. 4,111,779 and 4,108,742. These cells are used, for example, to carry out electrolysis of an aqueous alkali metal halide to produce a halogen, for example chlorine, and an alkali metal hydroxide such as sodium hydroxide. Generally, the bipolar, filter press-type electrolytic cell is composed of several bipolar unit cells arranged in series. One bipolar unit cell has an anode and cathode compartment separated by a partition wall. Typically, the anode and cathode are attached to opposite sides of the partition wall. The membrane is usually interposed between two adjacent unit cells to separate the anode compartment from the cathode compartment. A plurality of anode and cathode frames are installed in a parallel fashion and a longitudinal compressive, usually by a clamping means, is applied to the anode and cathode frames with the membrane inter posed between the frames to form the electrolytic cell completely.

During assembly of filter press type electrolytic cells, the membrane, interposed between an anode and cathode compartment, is held between the frames manually by personnel until squeezed. During disassembly of the cells, the membrane, again, must be held between the frames manually or it may fall between the frames and crease or wrinkle. The creasing or wrinkling of the membrane may cause the membrane to fail due to breaks or tearing during its use.

U.S. Pat. No. 4,170,535 discloses a membrane securing device which can be used to retain membranes in electrolytic cells during assembly and disassembly of the cell. The device in U.S. Pat. No. 4,170,535 comprises a non-conducting semi-rigid slotted tube which rests on the upper portion of the cell frame. The tube is at least one inch, preferably at least two inches in diameter. The upper edge of the membrane is stapled or otherwise attached to a plastic strip. The thickness of the strip is greater than the width of the slot so that the membrane with a strip attached to the top edge can be inserted into the slot and retained in the tube.

The disadvantage of the device in U.S. Pat. No. 4,170,535 is that no attachment device is provided to attach the top edge of the membrane to the plastic strip. Stapling the membrane to the strip as taught in the patent will not allow one to remove the plastic strip from the membrane without damaging the membrane. Leaving the plastic strip with the membrane on top of the cell frame will be possible only if there is enough spacing between the nozzles and lifting lugs or between the lifting lugs of the two adjacent cells. Otherwise, the plastic strip will have to stay above the nozzles and the lifting lugs. This arrangement also will be possible only if the membrane is wide enough to have more area hanging out on top of the cell.

Another disadvantage of the device disclosed in U.S. Pat. No. 4,170,535 is that the plastic strip with limited dimensions might not be rigid enough to hold a large size membrane flat without creasing or wrinkling it. Furthermore, the slotted tube which is used to retain the plastic strip inside and which is at least 1 inch, or preferably 2 inches in diameter, also can interfere with the nozzles and the lifting lugs on the top of the cell frame if the membrane is not wide enough to allow the tube to rest on top of the nozzles or lifting lugs.

It is therefore desired to provide a novel membrane hanging device which does not have the problems of the prior art.

SUMMARY OF THE INVENTION

An electrolysis cell membrane hanger comprising at least one means for clamping a membrane spaced apart and attached to an elongated support member and a means for adjusting the clamping means whereby the membrane is held securely by said clamping means.

DETAILED DESCRIPTION OF THE PREFERRED EMBODIMENT(s)

Figure 1:
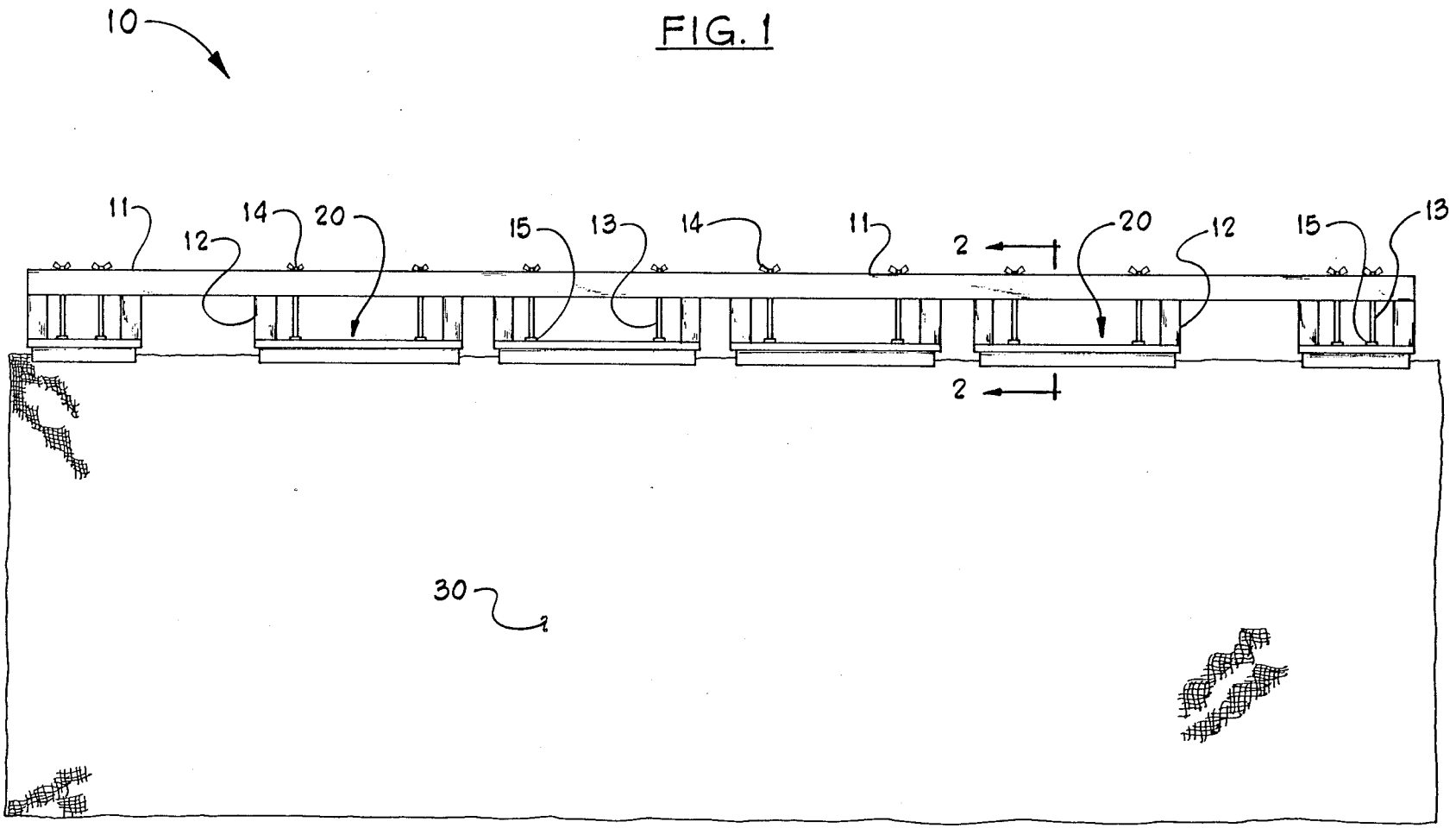
FIG. 1 is a plan view showing one embodiment of a membrane hanger of the present invention clamping a membrane.
Figure 2:
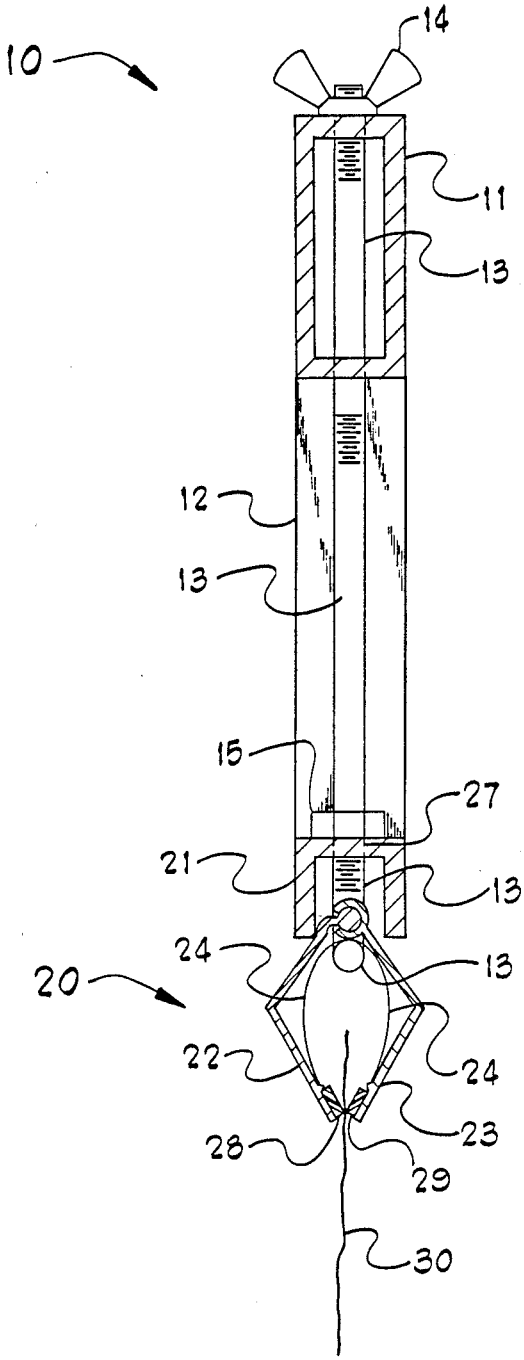
FIG. 2 is a cross-sectional view taken along line 2—2 of FIG. 1.

With reference to FIGS. 1 and 2, there is shown a membrane hanger of the present invention generally indicated by numeral 10. A membrane 30 is clamped by the hanger member 10. The hanger member 10 comprises a plurality of clamping sections, generally indicated by numeral 20 attached to an elongated support member 11. The elongated support member 11 is a continuous tube, bar, flat plate, or channel member 11. The clamping sections 20 are separate and apart from the channel member 11 and attached thereto by spacer means 12. The spacers 12 may be, for example, bar or tube support structures 12 joining the clamping sections 20 to the elongated member 11, for example, by welding.

The clamping sections 20 are activated, i.e., opened and closed, by threaded "T-shaped" rods or bolts 13 with the head of the "T" connected to the clamping sections 20 and the threaded bottom of the "T" passing through the channel member 11 and fastened thereto with tightening knobs or nuts 14. The threaded rod 13 and nut 14, such as a wing nut 14, are used to open and close the clamping sections 20. The clamping sections 20 include internal clamping members 22 and 23. A nut 15 is used to adjust the threaded rod 13 to maximize opening of clamping sections 20. The nut 15 functions to limit or restrict the opening of the clamping members 22 and 23 a predetermined distance.

Clamping members 22 and 23 (also referred to as clamping jaws or gripping arms 22 and 23) are fabricated so that the clamping members can be clamped to an ion-exchange membrane 30 being tentered. The nuts 14 can be adjusted on the hanger 10 by turning or tightening to tenter the membrane 30 and then the tentered membrane 30 with the hanger 10 can be placed in an electrolytic cell.

The clamping sections 20 also include a metal spring member 24 inside thereof. In this instance, the spring member 24 is flat plate bent in an inverted U-shape. The spring member 24 biases against the gripping arms 22 and 23. The clamping sections 20 include the top portions of the two clamping members (jaws or grips) 22 and 23 held against the inside of a U-shape clamp holder 21 by the T bolt 13. The threaded portion of T bolt 13 passes through an orifice 27 within the clamp holder 21. The U-shape clamp holder 21 is securely attached, for example by welding, to at least two spacer tubes 12 which are themselves welded to the channel member 11. The channel member 11 is used as a carrying frame support member 11 which is at least as long as the membrane sheet 30. The channel member 11, the spacers 12, and the clamp holder 21 are preferably made of a light weight, yet rigid material such as aluminum tube. Each clamp holder 21 has a least two T bolts 13 passing through holes 27 in the carrying frame 11. A wing nut 14 or other conventional fastening means at the end of each T bolt is used to open or close the clamping sections 20. The clamping jaws 22 and 23 are opened or closed by tightening or untightening a knob 14 at the end of the T-shaped bolt 13. The clamping jaws 22 and 23 also include a gripping means 28 and 29 attached thereto, respectively, for holding the membrane 30 minimizing tearing or damaging the membrane. To prevent the members 22 and 23 on the hanger 10 clamping sections 20 from damaging the membrane 30, the inside surface of arms 22 and 23, which contact the membrane 30, are preferably ground flat and rubber gaskets 28 and 29 are attached to inside faces of the clamping jaws 22 and 23. An adjustment means, nut 15, is threaded onto bolt 13 to preset the maximum opening clearance needed for members 22 and 23.

In the present invention, the hanger 10 is preferably used as an electrolysis cell membrane hanger as shown in FIGS. 1 and 2. The length and number of the clamping sections 20 may vary depending on the electrolyzer size and shape. Preferably, the length of each clamping section is cut to fit available spacing between any external appendages, such as lifting lugs or nozzle assemblies show normally disposed on top of a particular electrolyzer cell frame member (not shown). As aforementioned, the number of clamping sections depends on the number of available spacings on the top of the cell frame member.

In carrying out one embodiment of the present invention, an electrolysis cell membrane 30 is securely attached to the membrane hanger 10 by first laying the membrane flat on a table and then placing the membrane hanger 10 along the top edge of the membrane. The wing nuts 14 are untightened to open the clamping sections 20. The spring member 24 forces jaws 22 and 23 to open. The membrane hanger 10 is then moved towards the membrane so that the membrane top edge slides into the opened clamping sections 20. Care should be taken to avoid slack or wrinkles forming in the membrane in the space between two adjacent clamping sections 20 and between the clamping members 22 and 23. When the membrane top edge is flat and evenly placed inside the clamping sections, the wing nuts 14 at the end of the T bolts 13 are tightened up to close the clamping sections 20. The membrane 30 is then securely attached to the membrane hanger 10 and can be easily handled during installation into, or removal from an electrolysis cell without wrinkling or creasing the membrane. The clamped membrane may be handled, for example, by grasping the ends of the membrane hanger manually by hand, or by fastening chains or ropes to a hoist or crane. The membrane hanger may contain a fastening means such as an eye bolt, hook, or lifting lug (not shown) at various locations along the elongated support member 11, preferably at the ends thereof, for attaching, for example, a rope thereto.

The clamped membrane can then be moved vertically upward or downward into an electrolysis cell or out of the cell. Direct handling of the membrane by hand is therefore minimized so that contact with a treating solution which is typically on the membrane is minimized. When securing the membrane in accordance with the present invention, creasing and mechanical failure of the membrane is substantially eliminated.

What is claimed is:

1. A transportable electrolysis cell membrane hanger device for securing and handling a membrane during installation and removal from an electrolysis cell comprising:

(a) a transportable elongated support member for supporting at least one clamping means having a holder member;

(b) at least one clamping means having said holder member for clamping a membrane, said clamping means spaced apart and attached to the elongated support member, said clamping means including two elongated clamping members pivotably attached to each other;

(c) and a means for adjusting the clamping means such that the amount of compression on the membrane is held securely by said clamping means without damage to the membrane, whereby said holder member operates to hold the said clamping means in a closed position.

2. The hanger of claim 1 wherein the clamping means is attached to the elongated support member by a plurality of spacer means.

3. The hanger of claim 1 wherein the clamping means includes a spring means for bracing against the clamping members to open said clamping members.

4. The hanger of claim 1 wherein the adjusting means includes a threaded bolt with a head and threaded nut.

5. The hanger of claim 3 wherein the head of the threaded bolt is fastened to the clamping means and the leg of the bolt is fastened to the elongated support member.

6. The hanger of claim 1 including a means for restricting the opening of the clamping members.

7. The hanger of claim 1 including a means for fastening a lifting and/or handling device to said hanger.

8. The hanger of claim 1 wherein clamping members contain resilient gripping means.

9. A transportable electrolysis cell membrane hanger device for securing and handling a membrane during installation and removal from an electrolylsis cell comprising:

(a) a transportable elongated support member for supporting a plurality of clamping means;

(b) a plurality of clamping sections having holder members attached to the transportable elongated support member; the clamping sections comprising at least one clamping means for clamping a membrane, said clamping means spaced apart and attached to the elongated support member, said clamping means including two elongated clamping members pivotably attached to each other; said clamping sections sufficiently spaced apart to avoid constructions on an electrolysis cell when the membrane is compressed between adjacent electrolysis cell members; said holder members operating for holding the clamping means in a closed position; and (c) and a means for adjusting the clamping means such that the amount of compensation on the membrane by the clamping members is controlled whereby the membrane is held securely by said clamping means without damage to the membrane.

* * * * *

UNITED STATES PATENT AND TRADEMARK OFFICE

CERTIFICATE OF CORRECTION

PATENT NO. : 4,911,829

DATED : March 27, 1990

INVENTOR(S) : Roy L. Hicks, Gerald L. Shoults, and Hiep D. Dang

It is certified that error appears in the above-identified patent and that said Letters Patent is hereby corrected as shown below:

Column 1, Line 38; "inter posed" should be -- interposed--.

In Claim 1, Column 4, Line 36; after "brane" insert -- by the clamping members is controlled whereby the membrane--.

In Claim 5, Column 4, Line 48; "Claim 3" should be --Claim 4 --.

In Claim 9 (b), Column 5, Line 6; "constructions" should be -- obstructions--.

In Claim 9 (c), Column 6, Line 4; "compensation" should be --compression--.

Signed and Sealed this

Eighth Day of February, 1994

Bruce Lehman

*Attest:*

BRUCE LEHMAN

*Attesting Officer*

*Commissioner of Patents and Trademarks*